US005797716A

United States Patent [19]

Herrin

[11] Patent Number: 5,797,716

[45] Date of Patent: Aug. 25, 1998

[54] CONTAINER CONTENTS UNLOADING APPARATUS FOR UNLOADING CONTENTS OF A CONTAINER AND METHOD OF UNLOADING SAME

[76] Inventor: Robert M. Herrin, 5935 Groveline Dr., Orlando, Fla. 32810

[21] Appl. No.: 697,819

[22] Filed: Aug. 30, 1996

[51] Int. Cl.[6] ..... B65G 65/23

[52] U.S. Cl. ..... 414/420; 414/421; 414/788.7

[58] Field of Search ..... 414/413, 420, 414/421, 425, 778, 782, 788.7

[56] References Cited

U.S. PATENT DOCUMENTS

| | | | |
|---|---|---|---|
| 1,295,195 | 2/1919 | Parker . | |
| 1,474,857 | 11/1923 | Stebler et al. . | |
| 1,907,458 | 5/1933 | Stevenson . | |
| 1,917,709 | 7/1933 | Griffith et al. . | |
| 2,314,647 | 3/1943 | Longenecker | 414/421 X |
| 2,573,958 | 11/1951 | Eaddy | 414/420 |
| 2,711,838 | 6/1955 | Avery | 414/421 |
| 2,851,178 | 9/1958 | Rea et al. | 414/420 |
| 3,107,800 | 10/1963 | Gerrans | 414/413 |
| 3,767,073 | 10/1973 | DeGreef | 414/421 X |
| 4,234,279 | 11/1980 | Lotti . | |
| 4,280,779 | 7/1981 | Warner | 414/420 |
| 4,527,939 | 7/1985 | Suarez | 414/425 X |
| 4,688,980 | 8/1987 | Kikuchi et al. . | |
| 4,979,864 | 12/1990 | Cahlander et al. . | |
| 5,033,929 | 7/1991 | Marti | 414/421 X |
| 5,645,392 | 7/1997 | Leichty et al. | 414/788.7 X |

FOREIGN PATENT DOCUMENTS

| | | | |
|---|---|---|---|
| 0197709 | 1/1976 | U.S.S.R. | 414/420 |

*Primary Examiner*—James W. Keenan

*Attorney, Agent, or Firm*—Allen Dyer Doppelt Milbrath & Gilchrist

[57] ABSTRACT

A container contents unloading apparatus and method of unloading contents of a container are provided. The container contents unloading apparatus preferably includes a container conveyor positioned to convey one of a plurality of open-ended containers for unloading the contents of the open-ended container through the open end thereof. A container contents discharger preferably is positioned adjacent the conveyor for discharging the contents of a conveyed open-ended container. The container contents discharger includes a container holder for holding an open-ended container during lifting thereof. The container holder preferably is positioned to overlie the container conveyor during container loading and unloading and is positioned to receive a loaded open-ended container during container loading and to discharge an empty open-ended container during container unloading. A pivot mount is connected to an upper end portion of a proximal end of the container holder for pivoting the container holder and a container positioned therein about an upper end pivot axis. A lifter preferably is connected to a distal lower end portion of the container holder for lifting the container holder from the distal lower end portion thereof and for pivoting the container holder about the upper end pivot axis to unload the contents of a container being held by the container holder.

33 Claims, 5 Drawing Sheets

40
56
75
41
71

71
75
57
51
40

40
56
75
41
71

CONTAINER CONTENTS UNLOADING APPARATUS FOR UNLOADING CONTENTS OF A CONTAINER AND METHOD OF UNLOADING SAME

FIELD OF THE INVENTION

This application is related to the packing industry and, more particularly, to loading and unloading containers.

BACKGROUND OF THE INVENTION

In the produce industry, for example, produce is gathered by various techniques for eventual grading, sorting, preparing, packing, and shipping to customers. This gathered produce, however, has various shapes, sizes, and quality levels that impact how the produce is graded, sorted, prepared, and packed. Over the years, various systems have been developed in efforts to more efficiently grade, sort, prepare, and pack produce, as well as other items. Nevertheless, because the gathering process and much of the grading and sorting remains heavily manual labor intensive, problems that arise with systems such as unloading or loading containers cause problems, for example, with labor schedules (e.g., manual labor downtime), produce quality (e.g., such as with produce already picked and gathered), and administrative operations planning (e.g., for various shipments to customers).

Also, systems have been developed over the years where a forklift or other lifting, loading, and unloading system unloads a stack of containers onto a container conveyor before grading and sorting. Each of the containers has produce or other items deposited within the container. A destacker systematically destacks the stacked containers so that only one container at a time travels downstream on the container conveyor. Each of these containers having produce therein is then loaded onto a container contents unloading apparatus that lifts the container, pivots the container about a pivot point adjacent the upper proximal peripheral edge, and empties the contents of the container onto a produce conveyor.

These conventional container contents unloading systems, however, have several problems. For example, lifting and pivoting a container only about a pivot point adjacent the upper proximal peripheral edge of a container causes a tremendous amount of stress about the pivot point, provides little control over the lifting and emptying process, and requires a large drive such as a motor which requires additional energy and cost. Additionally, because little control is provided for the lifting and emptying process, little control is also provided with the lowering of the emptied container back onto the container conveyor after the emptying process is complete. Further, produce emptied onto the produce container can form an unmanageable mass or pile of produce for transporting downstream for grading and sorting.

OBJECTS AND SUMMARY OF THE INVENTION

With the foregoing in mind, it is an object of the present invention to provide a container contents unloading apparatus and method which provides smooth control over the unloading or dumping of contents of a container.

It is also an object of the present invention to provide a container contents unloading apparatus and method that reduces the stress on a single pivot point of the apparatus.

It is an additional object of the present invention to provide a container contents unloading apparatus and method that reduces the size of drive required for the lifting and emptying process.

It is still another object of the present invention to provide a container contents unloading apparatus and method that provides a more manageable amount of produce being deposited onto a produce conveyor when a container having produce positioned therein is emptied onto the produce conveyor.

It is a further object of the present invention to provide a container contents unloading apparatus and method that is more efficient, increases the speed of the lifting and emptying process, and reduces various problems associated with conventional systems such as described in the background above.

More particularly, a container contents unloading apparatus and methods of unloading a loaded container for enhancing the efficiency of unloading contents of containers is provided according to the present invention. The container contents apparatus preferably includes a container conveyor positioned to convey one of a plurality of open-ended containers for unloading the contents of the open-ended container through the open end thereof. Container contents discharging means preferably is positioned adjacent the conveyor for discharging the contents of a conveyed open-ended container. The container contents discharging means preferably includes holding means for holding an open-ended container during lifting thereof. The holding means is positioned to overlie the conveyor during container loading and unloading and is positioned to receive a loaded open-ended container during container loading and to discharge an empty open-ended container during container unloading. Pivot means is connected to an upper end portion of a proximal end of the holding means for pivoting the holding means and a container positioned therein about an upper end pivot axis. Lifting means preferably is connected to a distal lower end portion of the holding mean for lifting the holding means from the distal lower end portion thereof and for pivoting the holding means about the upper end pivot axis to unload the contents of a container being held by the holding means.

A container contents unloading apparatus according to the present invention can also include time and position controlling means operatively connected to the lifting means and the holding means for controlling the time and position of the lifting means and said holding means. The lifting means preferably lifts the distal lower end portion of the holding means along an arcuate path of travel during discharge of contents of a container. The lifting means preferably includes a boom having a proximal end thereof pivotally mounted to a frame member positioned adjacent the holding means and extending outwardly therefrom so as to overlie the holding means. An extension member preferably has an upper end connected to a distal end portion of the boom and a lower end connected to the lower end portion of the holding means. The boom extends downwardly during loading of an open-ended container and extends upwardly during discharging of the contents through the open end of the container. Drive means preferably is connected to the boom for driving the boom for lifting and lowering the holding means. The upper and lower ends of the extension member are respectively pivotally connected to the distal end portion of the boom and the lower end portion of the holding means so that when driving of the boom lifts the extension member the upper end of the extension member travels toward the proximal end of the boom.

Methods of unloading contents of a container are also provided according to the present invention. A method according to the present invention can include providing a container holder for holding at least one container positioned thereon and providing an elongate boom overlying the container holder. The boom preferably has a proximal end pivotally connected to a frame positioned adjacent the container holder. An extension member is provided having an upper end pivotally connected to a distal end portion of the boom and a lower end pivotally connected to a distal lower end portion of the container holder. A loaded container having an open upper end is positioned onto the container holder. A distal lower end portion of the container holder preferably is upwardly lifted with the boom along an arcuate path of travel at a predetermined speed about a pivot axis extending along a proximal upper end portion of the container holder for unloading the contents of the container through the open end thereof.

Another method of unloading contents of a container according to the present invention preferably includes conveying a plurality of loaded containers downstream to a container holder. Each of the plurality of containers preferably has an open upper end. One of the plurality of loaded containers is slidably positioned onto a container holder. A distal lower end portion of the container holder, or alternatively the container itself, is upwardly lifted along an arcuate path of travel at a first predetermined speed about a pivot axis extending along a proximal upper end portion of the container holder, or alternatively the container itself, for unloading the contents of the container through the open end thereof. The distal lower end portion of the container holder, or alternatively the container itself, is downwardly lowered at a second predetermined speed along the arcuate path, and the unloaded container is released for advancement downstream. The second predetermined speed is preferably greater than the first predetermined speed, and the second predetermined speed is greatly reduced after the container holder, or alternatively the container itself, reaches a predetermined lowered position and shortly before releasing the unloaded container for advancement downstream.

A further method according to the present invention preferably includes positioning a loaded container having an open upper end onto a container holder, and upwardly lifting a distal lower end portion of the container holder along an arcuate path of travel about a pivot axis extending along a proximal upper end portion of the container holder for unloading the contents of the container through the open end thereof. By lifting a distal lower end portion of the container holder along the arcuate path of travel, for example, the present invention advantageously provides a method for smoothly lifting the container holder having a loaded container positioned therein to thereby empty the contents onto a content conveyor without producing an unmanageable mass of contents for conveying downstream.

Additionally, the lifting means and time and position controlling means of the container contents unloading apparatus of the present invention advantageously provide an apparatus that quickly and efficiently lifts and lowers containers through a production process such as a produce dumping process as understood by those skilled in the produce industry. The container contents unloading apparatus and methods advantageously provide a quieter and more controlled unloading process and reduce the stress about a single pivot axis such as used by conventional unloading systems.

BRIEF DESCRIPTION OF THE DRAWINGS

Some of the objects, features, advantages, and uses of the present invention having been stated, others will become more apparent by referring to the following detailed description and drawings in which.

DETAILED DESCRIPTION

The present invention will now be described more fully hereinafter with reference to the accompanying drawings in which preferred embodiments of the invention are shown. This invention, however, may be embodied in many different forms and should not be construed as limited to the illustrated embodiments set forth herein. Rather, applicants provide these embodiments so that this disclosure will be thorough and complete, and will fully convey the scope of the invention to those skilled in the art. Like numbers refer to like elements throughout.

Figure 1:
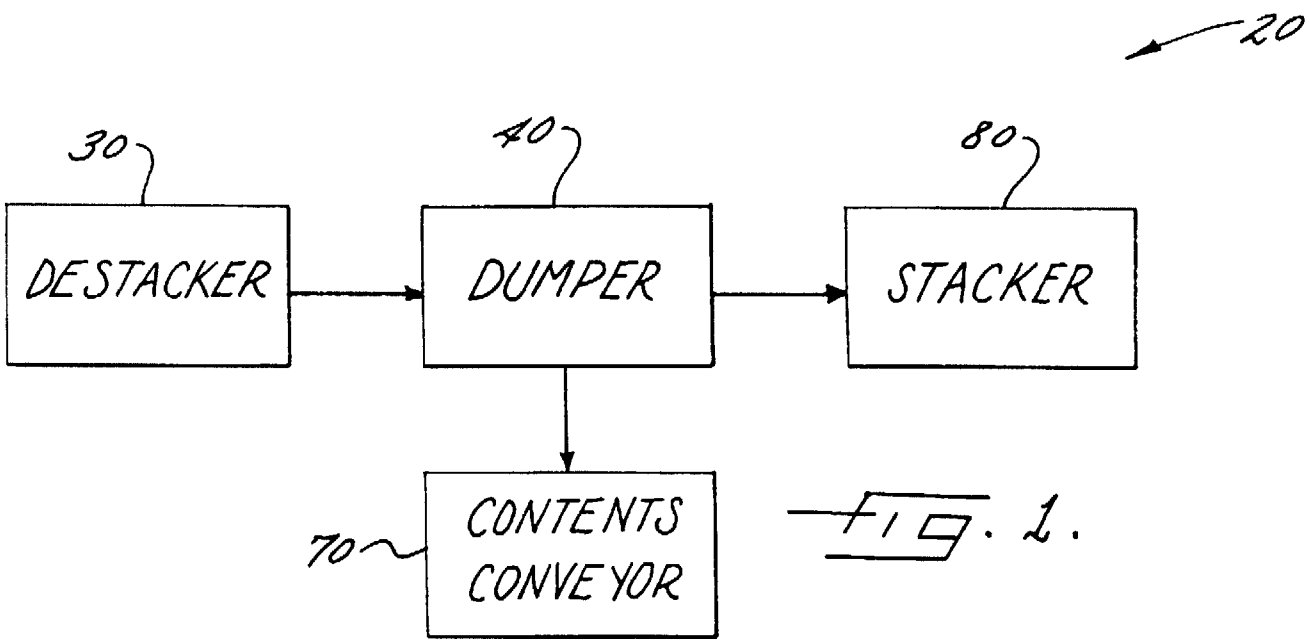
FIG. 1 is a schematic block diagram of a container contents unloading apparatus for unloading contents of a container according to the present invention.

FIG. 1 schematically illustrates a container contents unloading system 20 apparatus for enhancing the efficiency of unloading contents of open-ended containers C. The apparatus 20 as illustrated includes a destacker 30 for destacking a stack of a plurality of loaded containers C, container contents discharging means illustrated in the form of a dumper 40 positioned downstream from the destacker for discharging the contents of the containers C onto a contents conveyor 70, and a stacker positioned downstream from the dumper 40 for stacking a plurality of unloaded containers C. An apparatus 20 according to the present invention is particularly advantageous in the produce industry, for example, because the gathering process and much of the grading and sorting remains heavily manual labor intensive, labor schedules and administrative operations planning are important to maintain the gathering, packing, and grading and sorting processes profitable (e.g., manual labor downtime), and produce quality and timeliness of delivery of quality produce is important (e.g., such as with produce already picked and gathered). It will be understood by those skilled in the art, however, that the present invention will provide numerous advantageous in other industries such as mineral production and food processing as well.

Figure 2:
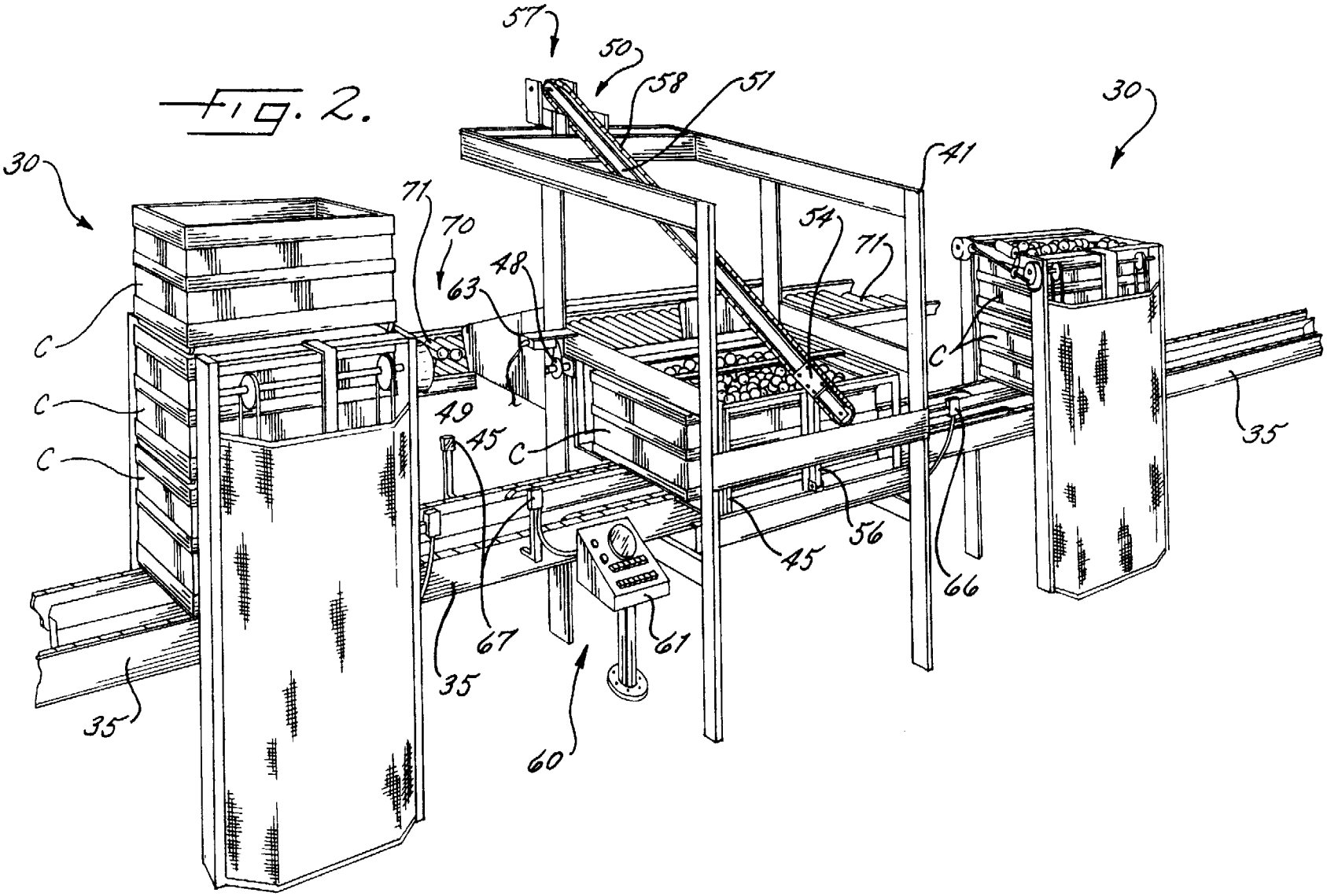
FIG. 2 is a front perspective view of a container contents unloading apparatus for unloading contents of a container according to the present invention.

As best illustrated in FIGS. 1–2, for high production speed and efficiency, such as in the produce packing industry, an apparatus 20 according to the present invention preferably has a frame 41, including a plurality of frame members, and a horizontally extending container conveyor 35 connected to the frame 41 and extending therethrough for conveying one of a plurality of open-ended containers C to and from the frame 41 for unloading the contents of the open-ended container through the open end of the container C. Container contents discharging means 40, e.g., a contents discharger, preferably is connected to the frame for discharging the contents of an open-ended container. The container contents discharging means preferably is a container contents discharger 40 illustrated in the form of a dump or dumper for dumping contents in the container C such as produce prior to grading and sorting.

Figures 6, 7:
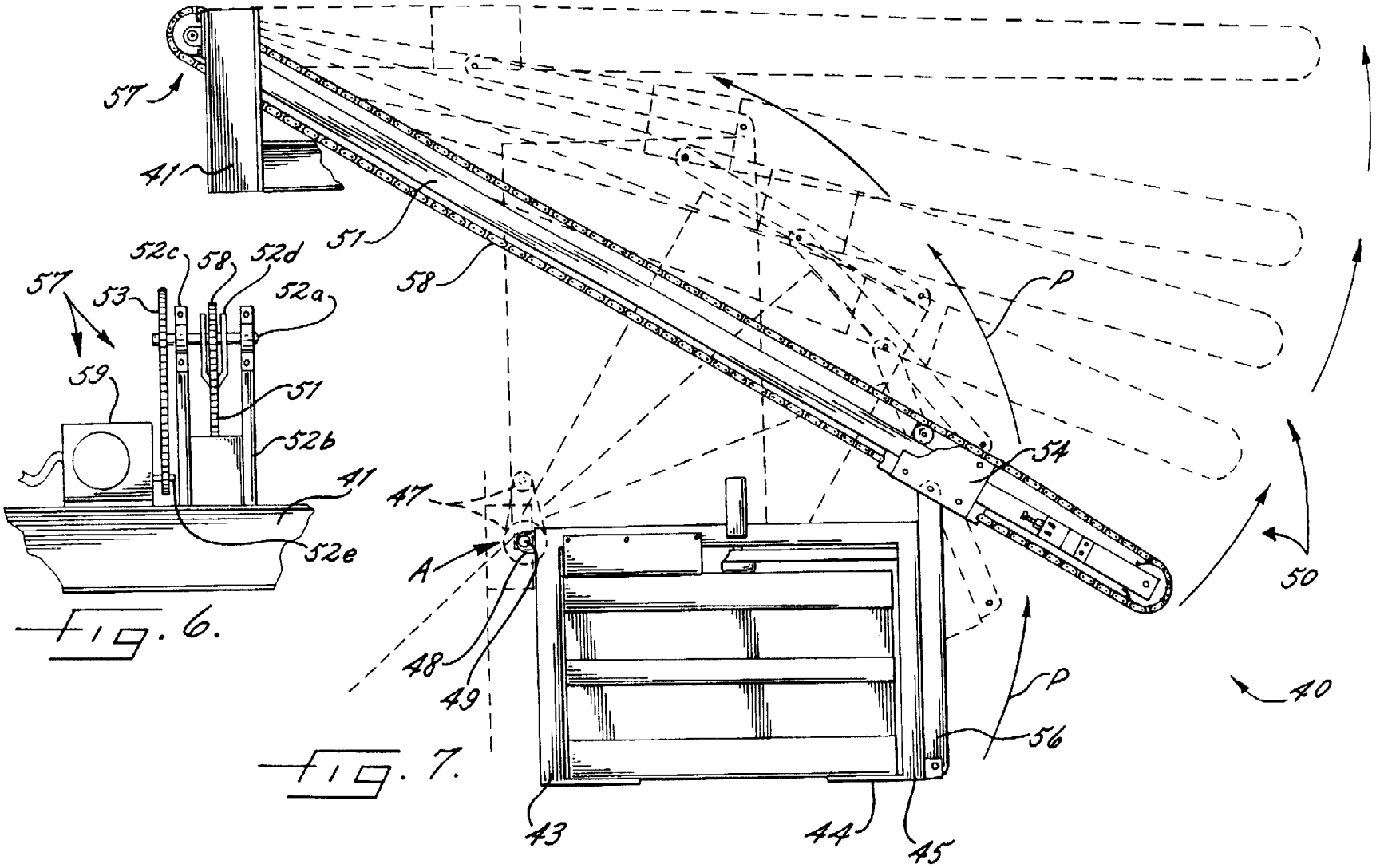
FIG. 6 is a fragmentary rear elevational view of a boom pivot mount assembly of a container contents unloading apparatus for unloading contents of a container according to the present invention.
FIG. 7 is a side elevational view of a boom of a container contents unloading apparatus for unloading contents of a container and illustrating raising and lowering positions in phantom according to the present invention.
Figure 8:
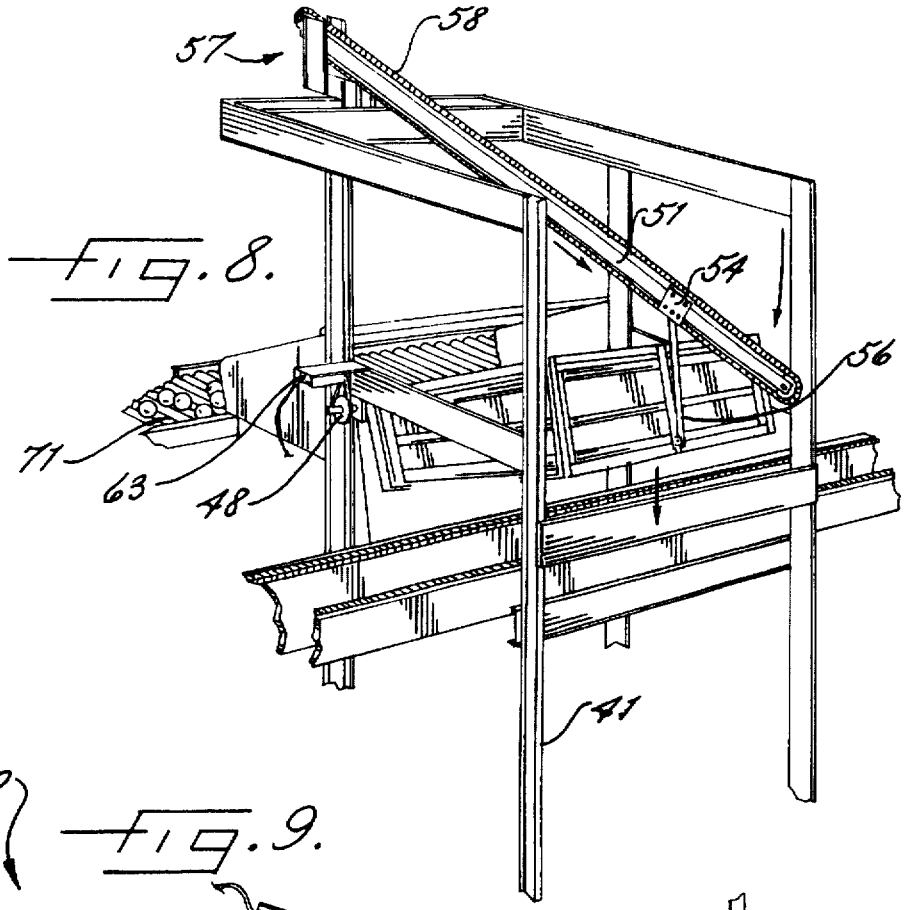
FIG. 8 is a front perspective view of a container contents unloading apparatus for unloading contents of a container and lowering an empty container onto a conveyor according to the present invention.
Figure 9:
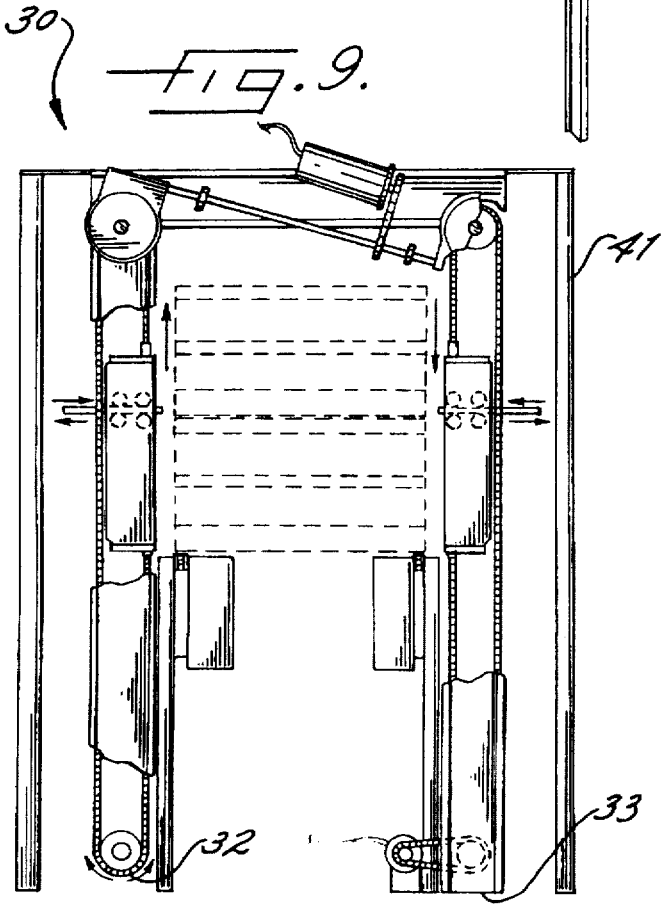
FIG. 9 is a top plan view of a container destacking apparatus of a container contents unloading apparatus for unloading contents of a container responsive to destacked containers according to the present invention.
Figure 10:
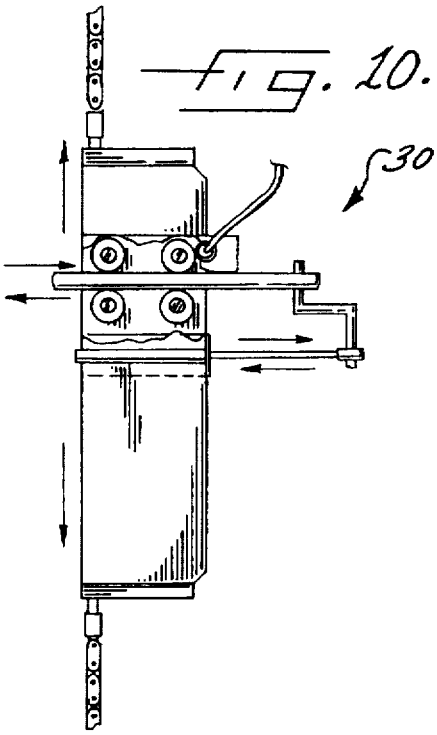
FIG. 10 is a fragmentary side elevational view of a container destacking apparatus of a container contents unloading apparatus for unloading contents of a container responsive to destacked containers according to the present invention.

As best shown in FIGS. 2 and 7–8, the container contents discharging means 40, more particularly, includes holding means 45, e.g., a container holder, for holding an open-ended container during lifting thereof. The holding means 45 is positioned to overlie the horizontally extending conveyor 35 during container loading and unloading and being positioned to slidably receive a loaded open-ended container C during container loading and to slidably discharge an empty open-ended container C during container unloading. The container holding means 45, e.g., a container holder, preferably is a rectangular-shaped housing arranged for slidably positioning lower ends of the housing so as to underlie a rectangular-shaped container C positioned on the container conveyor 35. The housing of the container holder 45 preferably has a framed or caged construction which minimizes the amount of frame material needed for the holder 45. The housing preferably includes proximal and distal frame walls 43, 44 as illustrated which each include a flange member extending inwardly so as to underlie a container when positioned within the holder 45. The container holder 45 provides a secure and quick way to hold the container C during the lifting and emptying processes. This illustrated embodiment, for example, can be particularly useful in a high speed production process such as used at a produce packing house. It will be understood by those skilled in the art, however, that other types, shapes, and constructions of a container holder 45 can be used as well according to the present invention.

Pivot means 48, e.g., a pivot mount, preferably is connected to an upper end portion of a proximal end of the holding means 45 for pivoting the holding means 45 and a container C positioned therein about an upper end pivot axis A. The pivot mount 48 preferably includes a pivot rod 49 extending at least a portion of, and preferably the entire length, of the proximal upper edge of the container holder 45. The pivot means also preferably includes a pivot drive 47, e.g., a motor, a drive chain, and wheeled sprockets, for driving the pivot rod so as to pivot the proximal upper edge of the container holder 45 about the pivot axis A.

Lifting means 50, e.g., a lifter, preferably is connected to a distal lower end portion of the container holder 45 for upwardly lifting the container holder 45 from the distal lower end portion thereof and for pivoting the holding means 45 about the upper end pivot axis A to unload the contents of a container C being held by the holding means 45. The pivot axis A preferably is positioned along an imaginary plane extending generally perpendicular to the horizontal plane of the container conveyor 35. The lifting means 50 upwardly lifts the lower end portion of the holding means 45 along an arcuate path of travel P about the pivot axis A during discharge of contents of a container C as best illustrated by the arrows in FIG. 7. The distal end of the boom 51 also travels along an arcuate path as illustrated by the arrows therein as well. The lifting means 50 also downwardly lowers the holding means 45 and an emptied container C held therein to be positioned closely adjacent the container conveyor 35. The holding means 45 releases the emptied container to be positioned to overlie and abuttingly contact the container conveyor 35 for advancing the emptied container downstream.

Figures 3, 4, 5:
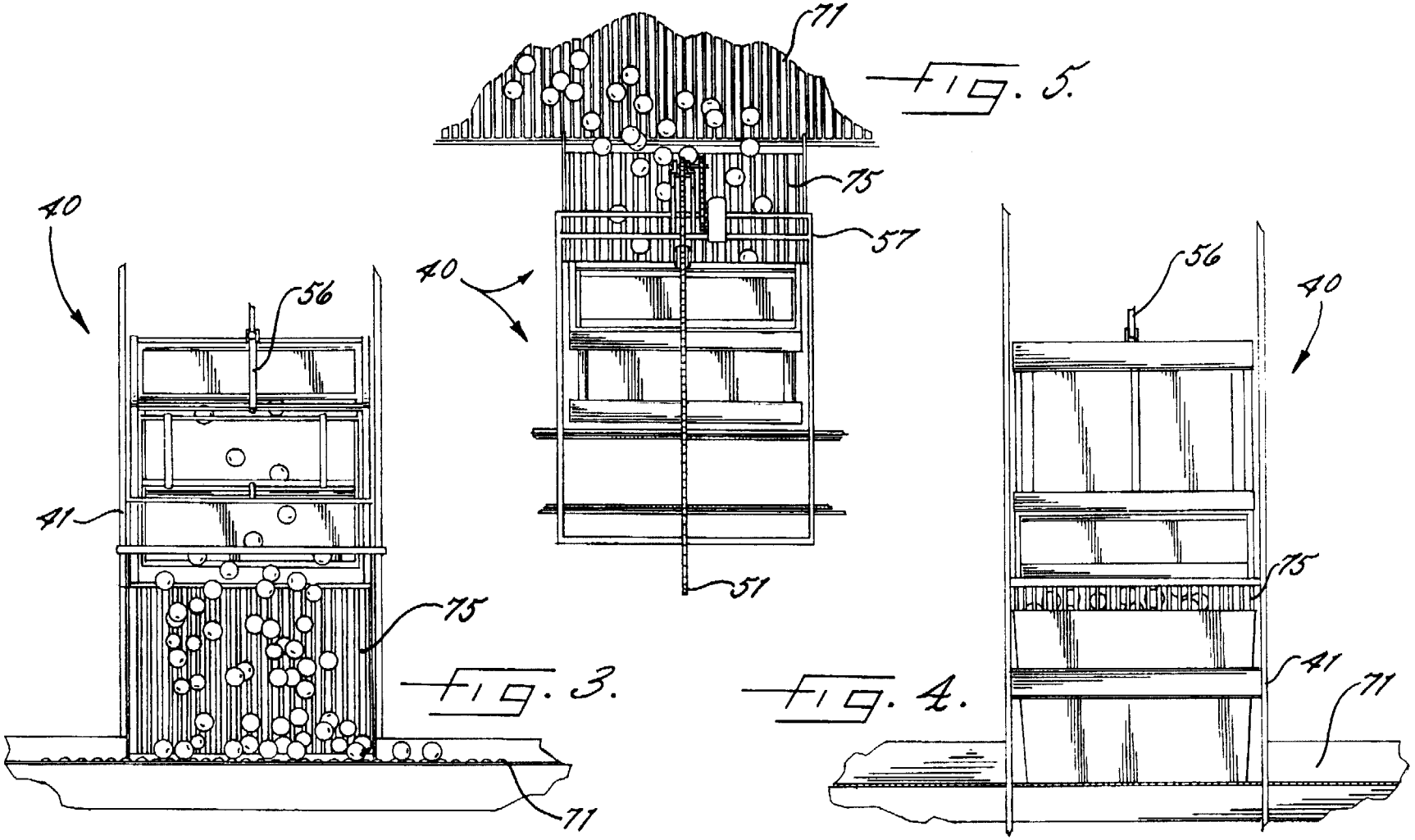
FIG. 3 is a rear elevational view of a container contents unloading apparatus unloading produce positioned in a container onto a conveyor according to the present invention.
FIG. 4 is a front elevational view of a container contents unloading apparatus unloading produce positioned in a container onto a conveyor according to the present invention.
FIG. 5 is a top plan view of a container contents unloading apparatus unloading produce positioned in a container onto a conveyor according to the present invention.

As best illustrated in FIGS. 3–5, a chute 75 preferably is positioned adjacent the container contents discharging means 40 and has an upper end thereof positioned to receive the contents from the open end of an open-ended container C during unloading thereof when the lifting means 50 is in the extended position. The chute 75 is preferably formed of a plurality of spaced apart rods or rollers which allow debris such as leaves, stems, sticks, grass, and various trash items to readily pass between the rods for collection by a trash receptacle positioned to underlie the chute 75. Contents conveying means 70, e.g., a horizontally extending container-contents conveyor 71, is positioned closely adjacent a lower end of the chute 75 for receiving contents of a container C from the chute 75 and conveying the contents downstream. The container-contents conveyor 71 conveys the discharged or unloaded contents such as produce, e.g., grapefruit, oranges, lemons, to grading and sorting processes downstream at the packing house. It will be understood by those skilled in the art that the upper end of the chute 75 can be positioned at a height well above the height of the container conveyor 35 so that the height of the packing warehouse is advantageously used by the apparatus 20. The lifting means 50 can then readily lift and lower the container holder 45 and a container C positioned thereon to a height for emptying, dumping, or unloading the contents of the container C as described above.

A container contents unloading apparatus 20 according to the present invention preferably also includes time and position controlling means 60 operatively connected to the lifting means 50 and the holding means 45 for controlling the time and position of the lifting means 50 and the holding means 45 (see FIGS. 2 and 7–8). The time and position controlling means 60 preferably includes a time and position controller 61 and at least one optical motion controller 63 connected to the container contents discharging means 40 and responsive to the time and position controller 61. Position sensors, e.g., optical sensors or detectors 66, 67 can also be positioned adjacent the respective upstream and downstream ends of the container holder 45 and be connected to the time and position controller 61 for sensing the entering and exiting of containers C therethrough.

As best illustrated in FIG. 7, the lifting means 50 of the apparatus 20 preferably includes an elongate boom 51 having a proximal end thereof pivotally mounted to the frame 41 and extending outwardly therefrom so as to overlie the holding means 45 and an extension member 56 having an upper end connected to a distal end portion of the boom 51 and a lower end connected to the lower end portion of the holding means 45. The boom 51 extends downwardly during loading of an open-ended container C and extends upwardly during discharging of the contents through the open end of the container C.

The container contents discharging means 40 further has drive means 57 connected to the boom 51 for driving the boom 51 to thereby lift and lower the holding means 45. The drive means 57 includes a primary drive chain 58 mounted to the boom 51 and a motor 59 for driving the primary drive chain 58 along the boom 51 (see FIG. 6). The primary drive chain 58 preferably is mounted on a pair of space-apart drive sprockets positioned at respective proximal and distal ends of the boom 51. The primary drive chain 58 extends between this pair of drive sprockets as illustrated. The drive means 57 can also include a plurality of mounting plates and drive shafts or rods 52*a*, 52*b*, 52*c*, 52*d*, 52*e* and a secondary drive chain 53 connected to the motor 59, the primary drive chain 58, and the proximal end of the boom 51 to mount and further assist in the driving of the boom 51. The boom 51 also includes a drive plate 54 connected to the drive chain 58. The upper and lower ends of the extension member 56 are respectively pivotally connected to the drive plate 54 of the boom 51 and the lower end portion of the holding means 45 so that when driving of the boom 51 lifts the extension member 56 the drive plate 54 and the upper end of the extension member 56 travel toward the proximal end of the boom 51. This movement of the boom 51 and the extension member 56 is best illustrated by the phantom lines in FIG. 7.

The lifting means 50 and time and position controlling means 60 of the container contents unloading apparatus 20 of the present invention advantageously provide an apparatus 20 that quickly and efficiently lifts and lowers containers C through a production process such as a produce dumping process as understood by those skilled in the produce industry. The container contents unloading apparatus 20 advantageously provides a quieter and more controlled unloading process and reduce the stress about a single pivot axis such as used by conventional unloading systems. Because the lifting, emptying, and lowering processes can be efficiently controlled by an apparatus 20 according to the present invention, for example, the container holder 45 can be decelerated or retracted to a lowered position quickly, then greatly slow down for providing a "kiss contact" or gentle abutting contact with the underlying container conveyor 35. The next loaded container C can then be positioned on the container holder 45 and the process repeated.

As best illustrated in FIGS. 1–2 and 9–10, a container contents unloading apparatus 20 according to the present invention can further include container destacking means 30, e.g., a container destacker, positioned upstream from the container contents discharging means 40 and closely adjacent the container conveyor 35 for receiving a stack of a plurality of containers C, e.g., two stacked containers are illustrated in FIG. 2, and destacking the stack of a plurality of containers C to thereby allow only individual containers C having contents positioned therein to advance downstream to the container contents discharging means 40. Likewise, container stacking means 80, e.g., a container stacker, is positioned downstream from the container contents discharging means 40 and closely adjacent the container conveyor 35 for receiving a plurality of individual emptied containers C and stacking the plurality of individual containers C, e.g., three stacked containers are illustrated in FIG. 2, to thereby allow the stacked plurality of individual containers C to advance downstream to unload the stacked plurality of individual containers C from the container conveyor 35. The time and position controller 61 is also preferably connected to destacking and stacking sensors mounted to the destacker 30 and the stacker 80 so that the entire apparatus and process can be efficiently controlled by an operator of the apparatus 20. This controller 61 therefore can advantageously be used to control the time and position of stacked, destacked, loaded, and unloaded containers C.

As illustrated in FIGS. 1–10, methods of unloading contents of a container C are also provided according to the present invention. A method according to the present invention includes providing a container holder 45 for holding at least one container positioned thereon and providing an elongate boom 51 overlying the container holder 45. The boom 51 preferably has a proximal end pivotally connected to a frame 41 positioned adjacent the container holder 45. An extension member 56 is provided having an upper end pivotally connected to a distal end portion of the boom 51 and a lower end pivotally connected to a distal lower end portion of the container holder 45. A loaded container C having an open upper end is positioned onto the container holder 45. A distal lower end portion of the container holder 45 preferably is upwardly lifted with the boom 51 along an arcuate path of travel P at a predetermined speed about a pivot axis A extending along a proximal upper end portion of the container holder 45 for unloading the contents of the container C through the open end thereof.

Another method of unloading contents of a container C according to the present invention preferably includes conveying a plurality of loaded containers C downstream to a container holder 45. Each of the plurality of containers C preferably has an open upper end. One of the plurality of loaded containers C is slidably positioned onto the container holder 45. A distal lower end portion of the container holder 45, or alternatively a container C itself, is upwardly lifted along an arcuate path of travel P at a first predetermined speed about a pivot axis A extending along a proximal upper end portion of the container holder 45, or alternatively a container C itself, for unloading the contents of the container C through the open end thereof. The distal lower end portion of the container holder 45, or alternatively a container C itself, is downwardly lowered at a second predetermined speed along the arcuate path P, and the unloaded container C is released for advancement downstream. The second predetermined speed is preferably greater than the first predetermined speed, and the second predetermined speed is greatly reduced after the container holder 45, or alternatively a container itself, reaches a predetermined lowered position and shortly before releasing the unloaded container C for advancement downstream.

A further method according to the present invention preferably includes positioning a loaded container C having an open upper end onto a container holder 45, and upwardly lifting a distal lower end portion of the container holder 45 along an arcuate path of travel about a pivot axis extending along a proximal upper end portion of the container holder 45 for unloading the contents of the container C through the open end thereof. By lifting a distal lower end portion of the container holder 45 along the arcuate path of travel P, for example, the present invention advantageously provides a method for smoothly lifting the container holder 45 having a loaded container C positioned therein to thereby empty the contents onto a contents conveyor 71 without producing an unmanageable mass of contents for conveying downstream.

Many modifications and other embodiments of the invention will come to the mind of one skilled in the art having the benefit of the teachings presented in the foregoing descriptions and the associated drawings. Accordingly, it is understood that the invention is not to be limited to the illustrated embodiments disclosed, and that the modifications and embodiments are intended to be included within the spirit and scope of the invention as described in the foregoing specification and as defined in the appended claims.

That which is claimed:

1. A container contents unloading apparatus for enhancing the efficiency of unloading contents of open-ended containers, the apparatus comprising:

a frame;

a horizontally extending container conveyor connected to said frame and extending therethrough for conveying one of a plurality of open-ended containers to an upstream end and from a downstream end of said frame along a generally horizontal plane of travel for unloading the contents of the open-ended container through the open end thereof;

container contents discharging means connected to said frame for discharging the contents of an open-ended container, said container contents discharging means including holding means for holding an open-ended container during lifting and lowering thereof, said holding means being positioned to overlie said horizontally extending conveyor during container loading and unloading and being positioned to slidably receive a loaded open-ended container during container loading and to slidably discharge an empty open-ended container during container unloading, pivot means connected to an upper end portion of a proximal end of said holding means for pivoting said holding means and a container positioned therein about an upper end pivot axis, and lifting means connected to a distal lower end portion of said holding means for upwardly lifting said holding means from the distal lower end portion thereof, for pivoting said holding means about the upper end pivot axis to unload the contents of a container being held by said holding means, and for downwardly lowering said holding means and an emptied container held therein to be positioned closely adjacent said container conveyor so that the holding means releases the emptied container to be positioned to overlie and abuttingly contact said container conveyor for conveying the emptied container from said frame along the same generally horizontal plane of travel;

a chute positioned adjacent said container contents discharging means and having an upper end thereof positioned to receive the contents from the open end of an open-ended container during unloading thereof when said lifting means is in the extended position; and a horizontally extending container-contents conveyor positioned closely adjacent a lower end of said chute for receiving contents of a container from said chute and conveying the contents therefrom.

2. A container contents unloading apparatus as defined in claim 1, further comprising time and position controlling means operatively connected to said lifting means and said holding means for controlling the time and position of said lifting means and said holding means.

3. A container contents unloading apparatus as defined in claim 1, wherein said lifting means lifts the lower end portion of said holding means along an arcuate path of travel during discharge of contents of a container.

4. A container contents unloading apparatus as defined in claim 1, wherein said lifting means comprises a boom having a proximal end thereof pivotally mounted to said frame and extending outwardly therefrom so as to overlie said holding means and an extension member having an upper end connected to a distal end portion of said boom and a lower end connected to the lower end portion of said holding means, said boom extending downwardly during loading of an open-ended container and extending upwardly during discharging of the contents through the open end of the container.

5. A container contents unloading apparatus as defined in claim 4, wherein said container contents discharging means further comprises drive means connected to said boom for driving said boom for lifting and lowering said holding means, and wherein said upper and lower ends of said extension member are respectively pivotally connected to the distal end portion of said boom and the lower end portion of said holding means so that when driving of said boom lifts said extension member the upper end of said extension member travels toward the proximal end of said boom.

6. A container contents unloading apparatus as defined in claim 1, wherein said container holding means comprises a rectangular-shaped housing arranged for slidably positioning a rectangular-shaped container therein.

7. A container contents unloading apparatus as defined in claim 6, further comprising container destacking means positioned adjacent said container contents discharging means and closely adjacent said container conveyor for receiving a stack of a plurality of containers and destacking said stack of a plurality of containers to thereby allow only individual containers having contents positioned therein to advance to said container contents discharging means.

8. A container contents unloading apparatus as defined in claim 7, further comprising container stacking means positioned adjacent said container contents discharging means and closely adjacent said container conveyor for receiving a plurality of individual emptied containers and stacking the plurality of individual containers to thereby allow the stacked plurality of individual containers to advance to unload the stacked plurality of individual containers from said container conveyor.

9. A container contents unloading apparatus for enhancing the efficiency of unloading contents of open-ended containers, the apparatus comprising:

a stationary frame;

a container conveyor extending through said frame and positioned to convey one of a plurality of open-ended containers along a generally horizontal plane of travel for unloading the contents of the open-ended container through the open end thereof; and container contents discharging means positioned adjacent said conveyor for discharging the contents of a conveyed open-ended container, said container contents discharging means including holding means for holding an open-ended container during lifting and lowering thereof, said holding means being positioned to overlie said conveyor during container loading and unloading and being positioned to receive a loaded open-ended container during container loading and to discharge an empty open-ended container during container unloading, pivot means connected to an upper end portion of a proximal end of said holding means for pivoting said holding means and a container positioned therein about an upper end pivot axis, and lifting means connected to a distal lower end portion of said holding means for lifting said holding means from the distal lower end portion thereof, for pivoting said holding means about the upper end pivot axis to unload the contents of a container being held by said holding means, and for downwardly lowering said holding means and an emptied container held therein to be positioned closely adjacent said container conveyor so that the holding means releases the emptied container to be positioned to overlie and abuttingly contact said container conveyor for conveying the emptied container from said frame along the same generally horizontal plane of travel.

10. A container contents unloading apparatus as defined in claim 9, further comprising time and position controlling means operatively connected to said lifting means and said holding means for controlling the time and position of said lifting means and said holding means, said time and position controlling means including a time and position controller and at least one optical motion controller connected to said container contents discharging means and responsive to said time and position controller.

11. A container contents unloading apparatus as defined in claim 10, wherein the pivot axis is positioned along an imaginary plane extending generally perpendicular to the horizontal plane of said container conveyor, and wherein said lifting means upwardly lifts the lower end portion of said holding means along an arcuate path of travel about the pivot axis during discharge of contents of a container.

12. A container contents unloading apparatus as defined in claim 11, wherein said lifting means comprises an elongate boom having a proximal end thereof pivotally mounted to said frame and extending outwardly therefrom so as to overlie said holding means and an extension member having an upper end connected to a distal end portion of said boom and a lower end connected to the lower end portion of said holding means, said boom extending downwardly during loading of an open-ended container and extending upwardly during discharging of the contents through the open end of the container.

13. A container contents unloading apparatus as defined in claim 12, wherein said container contents discharging means further comprises drive means connected to said boom for driving said boom for lifting and lowering said holding means, said drive means including a drive chain mounted to said boom and a motor for driving said drive chain along said boom, wherein said boom includes a drive plate connected to said drive chain, and wherein said upper and lower ends of said extension member are respectively pivotally connected to said drive plate of said boom and the lower end portion of said holding means so that when driving of said boom lifts said extension member the drive plate and the upper end of said extension member travel toward the proximal end of said boom.

14. A container contents unloading apparatus as defined in claim 13, wherein said container holding means comprises a rectangular-shaped housing arranged for slidably positioning lower ends of said housing so as to underlie a rectangular-shaped container positioned on said container conveyor.

15. A container contents unloading apparatus as defined in claim 14, further comprising container destacking means positioned adjacent said container contents discharging means and closely adjacent said container conveyor for receiving a stack of a plurality of containers and destacking said stack of a plurality of containers to thereby allow only individual containers having contents positioned therein to advance to said container contents discharging means and a contents conveyor positioned adjacent said container contents discharging means and at a different elevation than said container conveyor for receiving the contents from an emptied container and for conveying the contents therefrom.

16. A container contents unloading apparatus as defined in claim 15, further comprising container stacking means positioned adjacent said container contents discharging means and closely adjacent said container conveyor for receiving a plurality of individual emptied containers and stacking the plurality of individual containers to thereby allow the stacked plurality of individual containers to advance to unload the stacked plurality of individual containers from said container conveyor.

17. A container contents unloading apparatus for enhancing the efficiency of unloading contents of open-ended containers, the apparatus comprising:

a frame;

a container conveyor connected to said frame and extending therethrough for conveying one of a plurality of open-ended containers along a generally horizontal plane of travel for unloading the contents of the open-ended container through the open end thereof;

a container contents discharger positioned adjacent said container conveyor for discharging the contents of a conveyed open-ended container, said container contents discharger including a container holder for holding an open-ended container during lifting and lowering thereof, a pivot mount connected to an upper end portion of a proximal end of said container holder for pivoting said container holder and a container positioned therein about an upper end pivot axis, and a lifter connected to a distal lower end portion of said holder for lifting and lowering said container holder from a distal lower end portion thereof, for pivoting said container holder about the upper end pivot axis to unload the contents of a container being held by said container holder, and for downwardly lowering said container holder and an emptied container held therein to be positioned closely adjacent said container conveyor so that said container holder releases the emptied container to be positioned to overlie and abuttingly contact said container conveyor for responsively conveying the emptied container along the same generally horizontal plane of travel.

18. A container contents unloading apparatus as defined in claim 17, further comprising a time and position controller operatively connected to said lifter and said container holder for controlling the time and position of said lifter and said container holder.

19. A container contents unloading apparatus as defined in claim 17, wherein said lifter lifts the lower end portion of said container holder along an arcuate path of travel during discharge of contents of a container.

20. A container contents unloading apparatus as defined in claim 17, wherein said lifter comprises an elongate boom overlying said container holder and an extension member having an upper end connected to a distal end portion of said boom and a lower end connected to the lower end portion of said container holder, said boom extending downwardly during loading of an open-ended container and extending upwardly during discharging of the contents through the open end of the container.

21. A container contents unloading apparatus as defined in claim 20, wherein said container contents discharger further comprises a drive connected to said boom for driving said boom for lifting and lowering said container holder, and wherein said upper and lower ends of said extension member are respectively pivotally connected to the distal end portion of said boom and the lower end portion of said container holder so that when driving of said boom lifts said extension member the upper end of said extension member travels toward the proximal end of said boom.

22. A container contents unloading apparatus as defined in claim 17, wherein said container holder comprises a rectangular-shaped housing arranged for slidably positioning a rectangular-shaped container therein.

23. A container contents unloading apparatus as defined in claim 17, wherein said lifter entirely lifts said container holder from a first position closely adjacent said container conveyor to a second position having the entire lower end of said container holder lifted away from said container holder, and the contents unloading apparatus further comprising a contents conveyor positioned adjacent said container contents discharger and at a different elevation than said container conveyor for receiving the contents from an emptied container and for conveying the contents therefrom.

24. A container contents unloading apparatus for enhancing the efficiency of unloading contents of open-ended containers, the apparatus comprising:

a frame;

a horizontally extending container conveyor connected to said frame and extending therethrough for conveying one of a plurality of open-ended containers to an upstream end and from a downstream end of said frame for unloading the contents of the open-ended container through the open end thereof;

container contents discharging means connected to said frame for discharging the contents of an open-ended container, said container contents discharging means including holding means for holding an open-ended container during lifting thereof, said holding means being positioned to overlie said horizontally extending conveyor during container loading and unloading and being positioned to slidably receive a loaded open-ended container during container loading and to slidably discharge an empty open-ended container during container unloading, pivot means connected to an upper end portion of a proximal end of said holding means for pivoting said holding means and a container positioned therein about an upper end pivot axis, and lifting means connected to a distal lower end portion of said holding means for upwardly lifting said holding means from the distal lower end portion thereof for pivoting said holding means about the upper end pivot axis to unload the contents of a container being held by said holding means, said lifting means comprising a boom having a proximal end thereof pivotally mounted to said frame and extending outwardly therefrom so as to overlie said holding means and an extension member having an upper end connected to a distal end portion of said boom and a lower end connected to the lower end portion of said holding means, said boom extending downwardly during loading of an open-ended container and extending upwardly during discharging of the contents through the open end of the container;

a chute positioned adjacent said container contents discharging means and having an upper end thereof positioned to receive the contents from the open end of an open-ended container during unloading thereof when said lifting means is in the extended position; and a horizontally extending container-contents conveyor positioned closely adjacent a lower end of said chute for receiving contents of a container from said chute and conveying the contents therefrom.

25. A container contents unloading apparatus as defined in claim 24, wherein said container contents discharging means further comprises drive means connected to said boom for driving said boom for lifting and lowering said holding means, and wherein said upper and lower ends of said extension member are respectively pivotally connected to the distal end portion of said boom and the lower end portion of said holding means so that when driving of said boom lifts said extension member the upper end of said extension member travels toward the proximal end of said boom.

26. A container contents unloading apparatus for enhancing the efficiency of unloading contents of open-ended containers, the apparatus comprising:

a container conveyor positioned to convey one of a plurality of open-ended containers for unloading the contents of the open-ended container through the open end thereof; and container contents discharging means positioned adjacent said conveyor for discharging the contents of a conveyed open-ended container, said container contents discharging means including holding means for holding an open-ended container during lifting thereof, said holding means being positioned to overlie said conveyor during container loading and unloading and being positioned to receive a loaded open-ended container during container loading and to discharge an empty open-ended container during container unloading, pivot means connected to an upper end portion of a proximal end of said holding means for pivoting said holding means and a container positioned therein about an upper end pivot axis, and lifting means connected to a distal lower end portion of said holding means for lifting said holding means from the distal lower end portion thereof and for pivoting said holding means about the upper end pivot axis to unload the contents of a container being held by said holding means, said lifting means comprising an elongate boom having a proximal end thereof pivotally mounted to a frame and extending outwardly therefrom so as to overlie said holding means and an extension member having an upper end connected to a distal end portion of said boom and a lower end connected to the lower end portion of said holding means, said boom extending downwardly during loading of an open-ended container and extending upwardly during discharging of the contents through the open end of the container.

27. A container contents unloading apparatus as defined in claim 26, wherein said container contents discharging means further comprises drive means connected to said boom for driving said boom for lifting and lowering said holding means, said drive means including a drive chain mounted to said boom and a motor for driving said drive chain along said boom, wherein said boom includes a drive plate connected to said drive chain, and wherein said upper and lower ends of said extension member are respectively pivotally connected to said drive plate of said boom and the lower end portion of said holding means so that when driving of said boom lifts said extension member the drive plate and the upper end of said extension member travel toward the proximal end of said boom.

28. A container contents unloading apparatus as defined in claim 26, wherein said container holding means comprises a rectangular-shaped housing arranged for slidably positioning lower ends of said housing so as to underlie a rectangular-shaped container positioned on said container conveyor.

29. A container contents unloading apparatus as defined in claim 26, wherein said lifting means also downwardly lowers said holding means and an emptied container held therein to be positioned closely adjacent said container conveyor, and wherein said holding means releases the emptied container to be positioned to overlie and abuttingly contact said container conveyor for advancing the emptied container therefrom.

30. A container contents unloading apparatus as defined in claim 26, further comprising container destacking means positioned adjacent said container contents discharging means and closely adjacent said container conveyor for receiving a stack of a plurality of containers and destacking said stack of a plurality of containers to thereby allow only individual containers having contents positioned therein to advance to said container contents discharging means.

31. A container contents unloading apparatus as defined in claim 30, further comprising container stacking means positioned adjacent said container contents discharging means and closely adjacent said container conveyor for receiving a plurality of individual emptied containers and stacking the plurality of individual containers to thereby allow the stacked plurality of individual containers to advance to unload the stacked plurality of individual containers from said container conveyor.

32. A container contents unloading apparatus for enhancing the efficiency of unloading contents of open-ended containers, the apparatus comprising:

a container contents discharger for discharging the contents of a conveyed open-ended container, said container contents discharger including a container holder for holding an open-ended container during lifting and lowering thereof, a pivot mount connected to an upper end portion of a proximal end of said container holder for pivoting said container holder and a container positioned therein about an upper end pivot axis, and a lifter connected to a distal lower end portion of said holder for lifting and lowering said container holder from a distal lower end portion thereof and for pivoting said container holder about the upper end pivot axis to unload the contents of a container being held by said container holder, said lifter comprising an elongate boom overlying said container holder and an extension member having an upper end connected to a distal end portion of said boom and a lower end connected to the lower end portion of said container holder, said boom extending downwardly during loading of an open-ended container and extending upwardly during discharging of the contents through the open end of the container.

33. A container contents unloading apparatus as defined in claim 32, wherein said container contents discharger further comprises a drive connected to said boom for driving said boom for lifting and lowering said container holder, and wherein said upper and lower ends of said extension member are respectively pivotally connected to the distal end portion of said boom and the lower end portion of said container holder so that when driving of said boom lifts said extension member the upper end of said extension member travels toward the proximal end of said boom.

* * * * *